United States Patent [19]

Iino et al.

[11] Patent Number: 4,741,982

[45] Date of Patent: May 3, 1988

[54] PHOTOSENSITIVE MEMBER HAVING UNDERCOAT LAYER OF AMORPHOUS CARBON

[75] Inventors: Shuji Iino, Hirakata; Hideo Hotomi, Suita; Izumi Osawa, Ikeda; Mitsutoshi Nakamura, Osaka, all of Japan

[73] Assignee: Minolta Camera Kabushiki Kaisha, Osaka, Japan

[21] Appl. No.: 905,562

[22] Filed: Sep. 10, 1986

[30] Foreign Application Priority Data

Sep. 13, 1985 [JP] Japan ..... 60-204154
Sep. 19, 1985 [JP] Japan ..... 60-207898
May 17, 1986 [JP] Japan ..... 61-112847

[51] Int. Cl.[4] ..... G03G 5/14

[52] U.S. Cl. ..... 430/58; 430/61; 430/65

[58] Field of Search ..... 430/58, 65, 61, 62, 430/63, 64

[56] References Cited

U.S. PATENT DOCUMENTS

| | | | |
|---|---|---|---|
| 3,956,525 | 5/1976 | Yasuba | 427/41 |
| 4,365,013 | 12/1982 | Ishioka et al. | 430/57 |
| 4,376,688 | 3/1983 | Ceasar et al. | 204/192 |
| 4,394,426 | 7/1983 | Shimizu et al. | 430/65 |
| 4,409,308 | 10/1983 | Shimizu et al. | 430/60 |
| 4,416,755 | 11/1983 | Caesar et al. | 204/192 |
| 4,451,546 | 5/1984 | Kawamura et al. | 430/69 |
| 4,452,874 | 6/1984 | Ogawa et al. | 430/57 |
| 4,465,750 | 8/1984 | Ogawa et al. | 430/57 |
| 4,466,380 | 8/1984 | Jansen et al. | 118/712 |
| 4,471,042 | 9/1984 | Komatzu et al. | 430/64 |
| 4,490,450 | 12/1984 | Shimizu et al. | 430/57 |
| 4,491,626 | 1/1985 | Kawamura et al. | 430/69 |
| 4,495,262 | 1/1985 | Matsuzaki et al. | 430/58 |
| 4,510,224 | 4/1985 | Yamazaki et al. | 430/57 |
| 4,513,022 | 4/1983 | Jansen et al. | 427/39 |
| 4,513,073 | 4/1985 | Jeffrey, III et al. | 430/65 |
| 4,518,670 | 5/1985 | Matsuzaki et al. | 430/58 |
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/60 |
| 4,592,982 | 6/1986 | Saitoh et al. | 430/57 |
| 4,598,032 | 7/1986 | Saitoh et al. | 430/58 |
| 4,634,648 | 1/1987 | Jansen et al. | 430/84 |
| 4,686,164 | 8/1987 | Osawa et al. | 430/63 |

FOREIGN PATENT DOCUMENTS

| | | | |
|---|---|---|---|
| 194329 | 1/1977 | European Pat. Off. . | |
| 3525908 | 9/1978 | Fed. Rep. of Germany . | |
| 60125846 | 12/1978 | Japan . | |
| 5928161 | 3/1979 | Japan . | |
| 5586169 | 4/1980 | Japan . | |
| 5146130 | 5/1980 | Japan . | |
| 5938753 | 11/1980 | Japan . | |
| 150753 | 3/1981 | Japan . | |
| 61243460 | 10/1981 | Japan . | |
| 60130747 | 11/1981 | Japan . | |
| 115552 | 7/1982 | Japan . | |
| 88753 | 4/1983 | Japan . | |
| 154850 | 6/1983 | Japan . | |
| 171038 | 11/1983 | Japan . | |
| 136742 | 1/1984 | Japan . | |
| 214859 | 6/1984 | Japan . | |
| 5660447 | 11/1984 | Japan . | |
| 137977 | 4/1985 | Japan | 430/65 |
| 63541 | 4/1985 | Japan . | |
| 63531 | 7/1985 | Japan . | |
| 61761 | 11/1985 | Japan . | |

OTHER PUBLICATIONS

"A C-NMR Investigation of Plasma Polymerized Ethane, Ethylene, and Acetylene", by A. Dilks, S. Kaplan, and A. Vanlaeken, Xerox Webster Research Center, Xerox Square, W-114, Rochester, New York 14644. Journal of Applied Polymer Science, vol. 17, pp. 885-892 (1973), Formation of an Amorphous Powder During the Polymerization of Ethylene in a Radio-Frequency Discharge.

*Primary Examiner*—John L. Goodrow
*Attorney, Agent, or Firm*—Burns, Doane, Swecker & Mathis

[57] ABSTRACT

The present invention provides a new photosensitive member which comprises a hydrogen-containing carbon undercoat layer controlled in the polarity by an element of IIIA or VA group, a hydrogen-containing C:H charge transporting layer and a charge generating layer, which has an excellent charge transortability, a charging ability, and preventing properties of charge injection and of increase of residual potential.

16 Claims, 3 Drawing Sheets

PHOTOSENSITIVE MEMBER HAVING UNDERCOAT LAYER OF AMORPHOUS CARBON

BACKGROUND OF THE INVENTION

The present invention relates to a photosensitive member having an undercoat layer.

Recently, amorphous silicon (referred to as a-Si hereinafter) formed by a plasma chemical vapor deposition (referred to as plasma CVD) has been applied to produce a photosensitive member, especially electrophotosensitive members.

A-Si photosensitive members have several excellent properties. But the relative dielectric constant ($\epsilon$) of a-Si is so larger (about 12) that it essentially needs a thickness of at least 25 μm to gain a sufficient surface potential for a photosensitive member. In addition, in the production of an a-Si photosensitive member by plasma CVD a long production time is needed because of the slow deposition rate of an a-Si layer. The long deposition time makes it difficult to obtain a homogeneous a-Si layer, with the result that image defects such as white spot noises are liable to occur at a high percentage. Further, the cost becomes expensive.

Though many attempts to improve the above noted defects have been made, it is not preferable to make the layer thinner.

On the other hand, an a-Si photosensitive member has additional defects such as weak adhesive strength between a-Si layer and electroconductive substrate, and poor resistances to corona, external circumstances and chemicals.

It has been proposed to use an organic polymeric layer which is produced by plasma polymerization (referred to as OPP layer hereinafter) and is arranged as an overcoat layer or an undercoat layer in order to solve the above problems. The former is proposed for instance, in U.S. Pat. No. 3,956,525 and the latter is done in Japanese Patent KOKAI No. 63541/1985.

It is known that an OPP layer can be produced from various kinds of organic compound such as ethylene gas, benzenes, aromatic silanes and the like (e.g. Journal of Applied Polymer Science Vol. 17, 885–892 (1973), by A. T. Bell et al.). However, the OPP layer produced by these conventional methods is restrictively used as an insulator. Therefore, the layer is considered as an insulating layer having an electrical resistance of about $10^{16}$ Ω.cm as an ordinary polyethylene layer or at least similar to such a layer.

Recently, there has been proposed a layer comprising diamond-like carbon in the semiconductor field. But charge transportability thereof has not been suggested at all.

Japanese Patent KOKAI No. 136742/1984 discloses a photosensitive member having a carbon layer of 1–5 μm formed on an a-Si layer, which is applied on an Al substrate in order to prevent Al-diffusion to the a-Si layer at the exposure of light.

Japanese Patent KOKAI No. 61761/1985 discloses an a-Si photosensitive member coated with a diamond-like carbon layer insulator of 500 Å–2 μm thick as a surface protecting layer to improve corona discharge resistance of the photosensitive member and mechanical strength. The carbon layer is so thin that a charge can pass through the layer by the tunnel effect so the layer itself does not need a carrier transporting ability. It does not refer to the carrier transporting ability of the OPP layer. Further, it does not suggest the solution of the essential defect of the a-Si photosensitive member.

U.S. Pat. No. 3,956,525 discloses a photosensitive member consisting of a substrate, a sensitizing layer, an organic photoconductive electrical insulator and a glow discharging polymer layer having a thickness of 0.1–1 μm in the above order. This polymer layer is provided to cover the surface so as to stand up to wet development as an overcoat. Carrier transportability of the layer is not suggested.

Japanese Patent KOKAI No. 63541/1980 discloses a photosensitive member comprising an undercoat layer composed of a diamond-like carbon and having a thickness of 200 Å–2 μm and an a-Si photoconductive layer formed on said undercoat layer. This undercoat layer is formed to improve adhesion of the a-Si layer to the substrate. The undercoat layer may be so thin that a charge moves through it by tunnel effect.

As mentioned above, photosensitive members have been proposed which comprise an undercoat layer or an overcoat layer composed of an electrically insulating OPP layer, a diamond-like layer and the like, but charge transportability is basically attributed to the tunnel effect and the phenomena of dielectric breakdown.

The tunnel effect is caused owing to the passage of electrons, when the thickness of an insulating layer is very thin (generally at an Angstrom order).

The dielectric breakdown phenomenon is where existing small amounts of charge carriers are accelerated by an electric field to gain sufficient energy to be capable of ionizing atoms in the insulator, with the result that carriers increase by the ionization, and the carrier increases geometrically by the repetition of the same process. This phenomena occurs at a high electric field (generally more than 100 v/μm).

In the case of a photosensitive member having laminated layers of an insulating layer and a semiconducting layer, charges generated in the semiconducting layer move through in the layer under an electric field, but they can not pass through the insulating layer under a low electrical field. If the insulating layer is thin, it is ignored as a surface potential or it does not adversely affect properties of photosensitivity because of negligible development influence. Further, even if charges are accumulated on the insulating layer by repeated use to give a higher potential, the potential in the electric field does not increase above a constant level (e.g. 100 V/μm) because of dielectric breakdown.

For example, when an insulating layer comprising insulating materials capable of causing dielectric breakdown at 100 V/μm is formed at a thickness of 0.1 μm, the increase of the residual potential based on the repetition is only 10 V.

According to the above reasons, it is understood that if a conventional insulating layer is used for a photosensite member, the thickness of the layer has to be less than about 5 μm, or else the residual potential based on the insulating layer increases to more than 500 V causing an overlap of the copied image to occur.

As aforementioned, a conventional organic polymer layer in a photosensitive member is used as an undercoat layer or an overcoat layer, which probably requires no carrier transporting ability, and is used from the viewpoint that the layer is insulant. Therefore, only an extremely thin layer, at most 5 μm, is proposed. The carriers generated in the photosensitive layer pass through the organic polymer layer by a tunnel effect. In the case that the tunnel effect cannot be expected the layer is only used so as to be so thin that the residual potential is negligible.

It has been found that the organic polymer layer, which has been considered inherently insulant, has a carrier transporting capacity at some range of hydrogen content.

Further it has been found that when an undercoat layer consisting of a polarity controlled hydrogen-containing carbon layer is arranged on an electroconductive substrate, adhesivity to the substrate is improved and injection of charge from the substrate is prevented.

SUMMARY OF THE INVENTION

The main object of the present invention is to provide a photosensitive member with excellent transportability, chargeability and copying.

Another object of the present invention is to provide a photosensitive member having an undercoat layer, which can prevent the injection of charge from a substrate and the increase of a residual potential, and improve adhesion.

These and other objects of the invention can be accomplished to provide a photosensitive member which comprises;

an electrically conductive substrate;

an undercoat layer formed on said substrate and comprising hydrogen-containing carbon and an impurity element in Group IIIA or VA of the Periodic Table, said undercoat layer having a thickness of about 0.01 to 5 μm;

a charge transporting layer comprising hydrogen-containing carbon, said hydrogen being contained in an amount of about 0.1 to 67 atomic percent based on an amount of all atoms contained therein; and a charge generating layer.

DETAILED DESCRIPTION OF THE INVENTION

Figure 1:
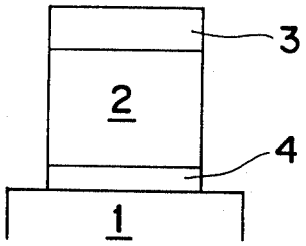
FIGS. 1–6 are schematic sectional views of photosensitive members of the present invention.

The present invention relates to a photosensitive member which comprises:

an electrically conductive substrate;

an undercoat layer formed on said substrate and comprising hydrogen-containing carbon and an impurity element in Group IIIA or VA of the Periodic Table, said undercoat layer having a thickness of about 0.01 to 5 μm;

a charge transporting layer comprising hydrogen-containing carbon, a hydrogen content of which is about 0.1 to 67 atomic percent;

a charge generating layer;

In the present specification the hydrogen-containing carbon layer used as the undercoat layer is referred to as the C:H undercoat layer, and that used as the charge transporting layer is referred to as the C:H charge transporting layer.

The C:H charge transporting layer of the present invention contains hydrogen at 0.1 to 67 atomic percent based on all atoms contained in the C:H charge transporting layer, preferably 1 to 60 atomic percent, more preferably 30 to 60 atomic percent, and most preferably 40 to 58 atomic percent. The C:H charge transporting layer having less than 0.1 atomic percent gives a dark resistance unsuitable for electrophotography, and more than 67 atomic percent will not give carrier transportability.

The C:H charge transporting layer of the present invention can be produced as an amorphous carbon or a diamond-like carbon according to the hydrogen content or the process for production. For the most part, an amorphous C:H layer is obtained, which is soft and of high resistance to electricity. However, when the layer having a hydrogen content of less than about 40 atomic percent is produced by the plasma CVD method, a diamond-like carbon layer can be obtained. Such a layer is harder having a Vickers hardness of more than 2000 and has a resistance of more than $10^8$ Ω.cm.

Further, the C:H layer of the present invention can be produced as a polymer layer, for example, a polymer layer formed by a plasma polymerization. A polymer layer formed by a plasma polymerization has a high density and ridigity, and is excellent in resistance to chemicals and heat. In addition, this polymer layer is characterized in that said layer has a larger dielectric loss compared to general polymer layers, since free radicals are trapped in said polymer layer. A preferable polymer layer formed by plasma polymerization is a polyethylene layer formed by plasma polymerization. The ratio of hydrogen atoms to carbon atoms in said polyethylene layer is about 2.7 to 2. Moreover, this polyethylene layer has a good heat resistance, i.e., heat resistance to more than 330° C.

These polymer layers formed by plasma polymerization show excellent charge transportability when combined with charge generating layers.

Hydrogen content of the C:H layer and the structure thereof can be determined by elemental analysis, IR analysis, $^1$H-NMR, $^{13}$C-NMR and the like.

A C:H charge transporting layer of the present invention has preferably an optical energy gap (Egopt) of from 1.5 to 3.0 eV, and a relative dielectric constant (ε) of from 2.0 to 6.0.

A C:H charge transporting layer having a smaller Egopt (less than 1.5 eV) forms many levels near the ends of the bands, that is, at the lower end of the conduction band and the upper end of the filled band. Therefore, in this case the C:H layer is not always suitable as a charge transporting layer because of its smaller mobility of carriers and shorter carrier life. A C:H layer having a larger Egopt (more than 3.0 eV) has a tendency to make a barrier at the interface between the charge generating materials and the charge transporting materials which are ordinarily used for an electrophotosensitive member, so there are cases when the injection of carrier from the charge generating layer to the C:H layer and from the C:H layer to the charge generating layer cannot be achieved. As the result, excellent photosensitive properties cannot be obtained.

In the meanwhile, where the relative dielectric constant (ε) is larger than 6.0, charging capacity and sensitivity decrease. Increasing the thickness of the C:H layer has been considered in order to overcome these drawbacks, but the increase in thickness of the C:H layer is not desirable for production. If the relative dielectric constant is less than 2.0, the properties of the C:H layer become similar to those of polyethylene so as to reduce the charge transportability.

The hydrogen contained in the C:H layers as a charge transporting layer may be partially substituted with halogens, for instance, fluorine, chlorine, bromine and the like. Such layers have an improved water repellancy and abrasion resistance due to the substitution.

The thickness of the C:H charge transporting layer is preferably about 5–50 μm, more preferably 7–20 μm. The C:H layer having a thickness of less than 5 μm has low charging capacity, with the result that a sufficient contrast can not be obtained on a copied image. A thickness of more than 50 μm is not desirable for production. The C:H charge transporting layer has an excellent light transparency, a high dark resistance and a high charge transportability. Even if the thickness of the layers exceeds 5 μm, carriers can be transported without trapping.

The C:H charge transporting layer of the present invention may be produced under ionized conditions by ion vapor deposition, ion beam deposition and the like; under plasma conditions by direct current, high frequency, microwave plasma methods and the like; and through a neutral particle by reduced compression CVD, vacuum vapor deposition, sputtering methods, optical CVD or a like and the combination thereof. However, for instance, in the case that charge generating layers are produced by a high frequency plasma or CVD, it is desirable to produce C:H charge transporting layers by the same method reduce apparatus costs and be labor saving.

Carbon sources for the C:H layer may include $C_2H_2$, $C_2H_4$, $C_2H_6$, $C_3C_6$, $CH_4$, $C_4H_{10}$, $C_4H_6$, $C_4H_8$, $C_3H_8$, $CH_3CCH$, $C_8H_8$, $C_{10}H_{16}$, and the like.

The carrier gas may preferably include $H_2$, Ar, Ne, He and the like.

According to the present invention an element belonging to group III A or VA of the Periodic Table may be incorporated into the C:H charge transporting layers in order to control the charging property thereof.

Reverse bias effect may be achieved by making the substrate side P-type and the surface side N-type when the photosensitive member is used in a positively charged state, and by making the substrate side N-type and the surface side P-type when it is used in a negative charged state. In the above manner various effects such as improvement of charging capacity a, decrease of the reduction rate of surface potential in darkness and an improvement of sensitivity of the photosensitive member can be obtained.

The polarity may be controlled by gradually increasing an element of group IIIA or VA in the surface side or the substrate side within the same layer, or a single C:H charge transporting layer containing an element of group IIIA or VA may be arranged on the surface side or the substrate side. Alternatively, if necessary, plural C:H C:H transporting layers with different concentrations of an element of IIIA or VA group may be arranged at conjunction areas so as to form depletion layers.

In order to incorporate elements of group IIIA into C:H charge transporting layer suitable gaseous compounds containing these elements are deposited with hydrocarbon gas under an ionized state or a plasma state. Alternatively, C:H charge transporting layer may be exposed to gas containing elements of group IIIA to be doped.

Compounds containing boron may include $B(OC_2H_5)_3$, $B_2H_6$, $BCl_3$, $BBr_3$, $BF_3$ and the like.

Compounds containing aluminum may include $Al(Oi—C_3H_7)_3$, $(CH_3)_3Al$, $(C_2H_5)_3AL$, $(i—C_4H_8)_3Al$, $AlCl_3$ and the like.

Compounds containing gallium may include $Ga(Oi—C_3H_7)_3$, $(CH_3)_3Ga$, $(C_2H_5)_3Ga$, $GaCl_3$, $GaBr_3$ and the like.

Compounds containing indium may include $In(Oi—C_3H_7)_3$, $(C_2H_5)_3In$ and the like.

The content of group elements of IIIA may be preferably not more than 20000 ppm, more preferably about 3–1000 ppm. The content of such an element in the C:H charge transporting layer must be less than the content in C:H undercoat layer.

Elements of group VA used for polarity control may be P, As, and Sb, especially P. The elements of group VA may be incorporated into the C:H charge transporting layer in the same manner as Group IIIA.

Compounds containing elements of group VA useable in the present invention, may include $PO(OCH_3)_3$, $(C_2H_5)_3P$, $PH_3$, $POCl_3$ and the like as a compound containing P; $AsH_3$, $AsCl_3$, $AsBr_3$ and the like as a compound containing As; $Sb(OC_2H_5)_3$, $SbCl_3$, $SbH_3$ and the like as a compound containing Sb.

The content of the elements of group VA is preferably not more than 20000 ppm, more preferably about 1–1000 ppm. The content of such an element in the C:H charge transporting layer must be less than that in the C:H undercoat layer.

The properties of charge generating layer of the photosensitive members may be controlled by incorporating additional elements.

There are cases when the charge transporting layers are colored to, for instance, yellow, blue, brown or so according to a production condition or by impurity contamination. In some cases such a phemonena may be utilized to prevent injurious light from transmitting to the charge generating layers.

Surface barriers between charge generating layers and charge transporting layers may be made smaller by incorporating Si or Ge into the latter to control band gap. In embodiments of FIG. 1 a large quantity of Ge (more than 10 atomic %) may be incorporated into layers near the substrate, by which reflection of surplus light can be prevented, so that interference fringes and blurredness can be prevented.

Nitrogen, oxygen, sulfur and/or various kinds of metals may be additionally incorporated into the C:H charge transporting layers, or a part of hydrogen of the C:H layer may be substituted with halogen.

As a nitrogen source $N_2$, $NH_3$, $N_2O$, NO, $NO_2$ and the like may be used in general, and addition thereof can make the surface barrier smaller between charge generating layers and charge transporting layers.

As an oxygen source $O_2$, $O_3$, $N_2O$, NO and the like are exemplified. The incorporation of these compounds improves charging capacity, and can accelerate the plasma CVD charge transporting layer formation rate.

As a sulfur source $CS_2$, $(C_2H_5)_2S$, $H_2S$, $SF_6$, $SO_2$ and the like are exemplified. The incorporation of sulfur is effective for the prevention of light absorption and light interference. The rate of layer formation can also be made faster.

By the substitution of hydrogen in the C:H charge transporting layer with halogen water repellance, rubbing resistance and light transmittance can be improved. Especially when the substitution is of fluorine, —CF, $—CF_2$, $—CF_3$, and the like the refractive index (n) becomes smaller (eg. 1.39) so that reflection also becomes smaller.

If the C:H charge transporting layer obtained by the above is contacted with the atmosphere after argon treatment, carbonyl groups are formed on the surface of the layer to be activated and the $—CF_2$ group is changed to —CF.

By introduction of a small amount of Si or Ge a hard layer with rubbing resistance and water repellance can be produced. Further, the incorporation of both facilitates the injection of charge from a charge generating layer to give a desirable effect such as decrease of residual potential and increase of sensitivity.

As a source of carbon and halogen $C_2H_5Cl$, $C_2H_3Cl$, $CH_3Cl$, $CH_3Br$, $COCl_2$, $CCl_2F_2$, $CHClF_2$, $CF_4$, HCl, $Cl_2$, $F_2$ and the like may be used. Exemplified are $GeH_4$ as a source of germanium; $SiH_4$ as a source of silicon; $H_2Te$ as a tellurium; $H_2Se$ as a source of selenium; $AsH_3$ as a source of arsenic; $SbH_3$ as a source of antimony; $BCl_3$ and $B_2H_6$ as a source of boron; and $PH_3$ as a source of phosphorus.

Charge generating layers which may be used in the present invention are not restrictive. Any charge generating layer may be used. Examples of these layers may be a-Si layers which may contain various kinds of element to change the properties of the layers such as C, O, S, N, P, B, Ge, halogen and the like, and may be of multilayer structures; Se layers; Se-As layers; Se-Te layers; CdS layers; layers made by binding inorganic or organic charge generating compounds with resinous materials; and the like. Such inorganic compounds may include zinc oxide and the like, and such organic compounds may include bis-azo compounds, triarylmethane dye, thiazine dye, oxazine dye, xanthene dye, cyanine dye, styryl dye, pyryliums, azo compounds, quinacridones, indigos, perillenes polycyclic quinones, bisbezimidazoles, Indanthrenes, squaliliums, phthalocyanines and the like.

Other compounds, so far as these can absorb light to generate carriers at a high efficiency, can be used. Charge generating layers may be formed by any method.

The charge generating layers of the present invention may be arranged anywhere as described later, such as an outermost layer, an innermost layer or a middle layer. The thickness of charge generating layers may be designed such that 90% of 555 nm light can generally be absorbed, which depends on the kind of materials, especially spectrophotoabsorption properties, sources of light exposure, objects and the like. In the case of a-Si:H, the thickness of the layer is generally about 0.1–1 μm.

As the C:H undercoat layer of the present invention any hydrogen containing carbon layer may be used. For example, the layer may be a polyethylene layer, an organic plasma polymerized layer or a hydrogen-containing carbon layer as aforementioned providing that if elements of group IIIA or VA are incorporated the concentration is more than in the C:H charge transporting layer.

The hydrogen content of the C:H undercoat layer is preferably about 0.1 to 67 atomic percent. In order to improve the adhesivity and deformation resistance, the hydrogen content is preferably about 30 to 67 atomic percent, more preferably 40 to 65. The hydrogen content can be determined by a method as aforementioned.

The thickness of a C:H undercoat layer for general electrophotography is about 0.01 to 5 μm, especially about 0.05 to 1 μm. A C:H undercoat layer of less than 0.01 μm thick does not give an improved adhesivity with a substrate, and an effect to prevent charge injection.

A C:H undercoat layer of more than 5 μm thick is not preferable for production reasons.

In the present invention an element of group IIIA or VA is incorporated into the C:H undercoat layer.

A C:H undercoat layer formed between the substrate and the carrier generating layer or the carrier transporting layer is controlled to be a P type by an element from group IIIA, when a photosensitive member is used with a positive charge, but to an N type by an element from group VA, when it is used with a negative charge. By the above treatment a negative charge introduced into the substrate is prevented from injection, and a hole generating in the charge generating layer can easily transport to the substrate when a P type undercoat is used with a negative charge. Similarly, when a N type undercoat is used a negative charge the injection of holes from the substrate is prevented and a electron easily transports to the substrate, so that charging capacity, reduction at dark and sensitivity are improved. From the above, when a photoconductive layer is used as a surface layer, if the surface is controlled to be a N type for a positive charge or to a P type for a negative charge, the injection of the surface charge is effectively prevented.

In other words, when a photosensitive member is used with a positive charge, a retro-bias effect is desirably achieved by controlling the undercoat layer to be a P type and controlling the surface side to be a N type; when it is used with a negative charge the undercoat is controlled to be a N type. This effectively improves charging ability, reduction at dark, and sensitivity.

Such polarity control may be achieved by gradually increasing a content from group an element of IIIA or VA toward the substrate side or the surface side in a single layer, or by arranging a single undercoat layer containing an element from group IIIA or VA at an even concentration at the substrate side. A C:H undercoat layer containing the above elements at various concentration may be arranged at a conjunction area such that a depletion layer is formed.

The content of the elements of group is IIIA preferably not more than 20000 ppm, more preferably about 3 to 1000 ppm.

The content of the elements of VA group is preferably not more than 20000 ppm, more preferably about 1 to 1000 ppm.

The content of the elements from group IIIA or VA in the C:H undercoat layer must be more than that in the C:H charge transporting layer. The examples of compounds containing such elements are the same as those used in the C:H charge transporting layer.

Further the C:H undercoat layer may contain other elements such as oxygen, sulfur, halogen, silicon, germanium, and like, the sources of which are the same as described in the above charge transportation layer.

The method of incorporation of group an element of IIIA VA or other elements and source thereof may be the same method as described in the production of the C:H charge transporting layer.

FIG. 1 is a schematic sectional view of a photosensitive member of the present invention. In the figures a substrate (1), a C:H charge transporting layer (2), a charge generating layer (3) and a C:H undercoat layer (4) are illustrated. If the photosensitive member of FIG. 1 is positively charged and then exposed to a light image, charge carriers are generated in the charge generating layer (3), with the electrons therefrom neutralizing the surface charge. The holes move toward the substrate (1) due to the excellent charge transportability of the C:H charge transporting layer (2). When an a-Si charge generating layer without any polarity control is used with a positive charge, the C:H charge transporting layer is preferably controlled to be a P type. Since a-Si itself is of weak N type or intrinsic, it has a tendency to control the injection of positive charge from the surface, and a C:H charge transporting layer controlled to be a P type facilitates the movement of holes. In such an embodiment if the C:H undercoat layer is controlled to P-type by incorporating an element from the VA group, residual potential can be minimized.

When the photosensitive member is used with a negative charge, the C:H charge generating layer (3) may be controlled to be a P type. The C:H charge transporting layer (2) is preferably controlled to be a N type by incorporating P therein, and the undercoat layer to be a N type also by incorporating P therein.

Figure 2:
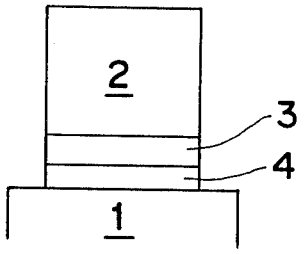

FIG. 2 illustrates a photosensitive member containing a C:H charge generating layer as an outermost layer. When this member is used with a positive charge, the polarity of the C:H charge transporting layer (2) may be controlled to be a N-type in comparison to the charge generating layer (3) by an element from group VA so as to facilitate mobility of electrons. In this case, the undercoat layer is preferably controlled to be a P-type relatively. When the member is used with a negative polarity, the C:H transporting layer is preferably inversely controlled.

Figure 3:
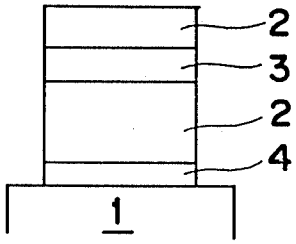

The photosensitive member of FIG. 3 is an embodiment containing a C:H layer (2) on the upper and lower sides of the charge generating layer (3). When it is used with a positive polarity, it is desirable to control the upper C:H layer (2) to be an N-type in comparison with the charge generating layer (3) so as to facilitate mobility of electrons, whereas the lower C:H layer (2) is controlled to be a P-type. Further, the C:H undercoat layer (4) is controlled to be a P-type to prevent injection of charges from the substrate. When the photosensitive member is used with a negative polarity, the upper C:H layer (2) is controlled to be a P-type, whereas the lower C:H layer (2) and the C:H undercoat layer (4) are controlled to be N-types.

Figure 4:
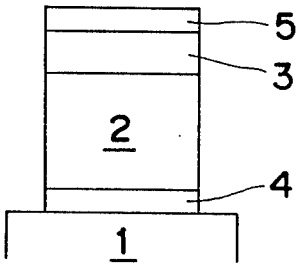
Figure 5:
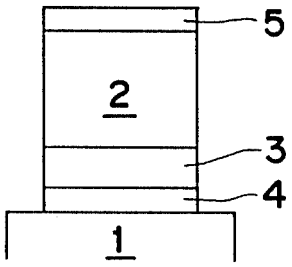
Figure 6:
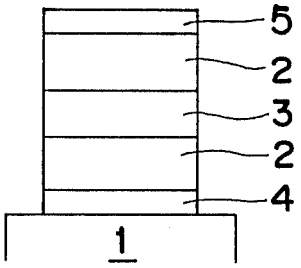

Photosensitive members illustrated in FIGS. 4 to 6 have overcoat layers (5) on the photosensitive members of FIGS. 1 and 3 respectively. The overcoat layers act as a surface protective layer for a charge generating layer (3) and a C:H charge transporting layer, and improve the initial surface potential. The thickness of the overcoat layer is preferably about 0.01–5 μm. As a surface protective layer any materials which are usually used therefor may be used. In the present invention the protective layer may preferably be formed by organic plasma polymerization for production reasons. The overcoat layers may be the C:H layer. Elements of group IIIA or VA may be doped into the surface protective layer (5), if necessary.

In a photosensitive member having any embodiment as aforementioned the C:H undercoat layer (4) contains an element of Group IIIA with a positive charge or an element of Group VA with a negative charge, so as to prevent charge injection from the substrate. In addition, a charge carrier generating in a charge generating layer (3) is transported to the substrate side without any trap, because the undercoat itself has charge transportability. The overcoat layer of the charged photosensitive member is preferably controlled to be a polarity opposite to that of the undercoat, that is, if the undercoat is controlled to be a P type, the overcoat is desirably controlled to be a N type.

The photosensitive member shown in FIGS. 1–6 may be a multilayer type containing a undercoat layer or plural carrier transporting layers and/or carrier generating layers.

Other elements such as Si, Ge and the like may be incorporated into the charge transporting layer or the undercoat layer to minimize the boundary barrier. A larger quantity of Ge (e.g. more than 10 atomic percent) is located in the photoconductive layer near the substrate to prevent excess light from reflecting so as to prevent fringe interference and obscure copied images.

The photosensitive member of the present invention contains a carrier generating layer, a carrier transporting layer and an undercoat layer. Therefore, at least three processes are needed to produce the member. When a-Si layers are formed using, for example, an apparatus adopted for glow discharge decomposition, plasma polymerization can be carried out in the same apparatus. Therefore, a C:H charge transporting layer, an undercoat layer, a surface protective layer, a barrier layer and the like are preferably produced by the plasma polymerization.

Figure 7:
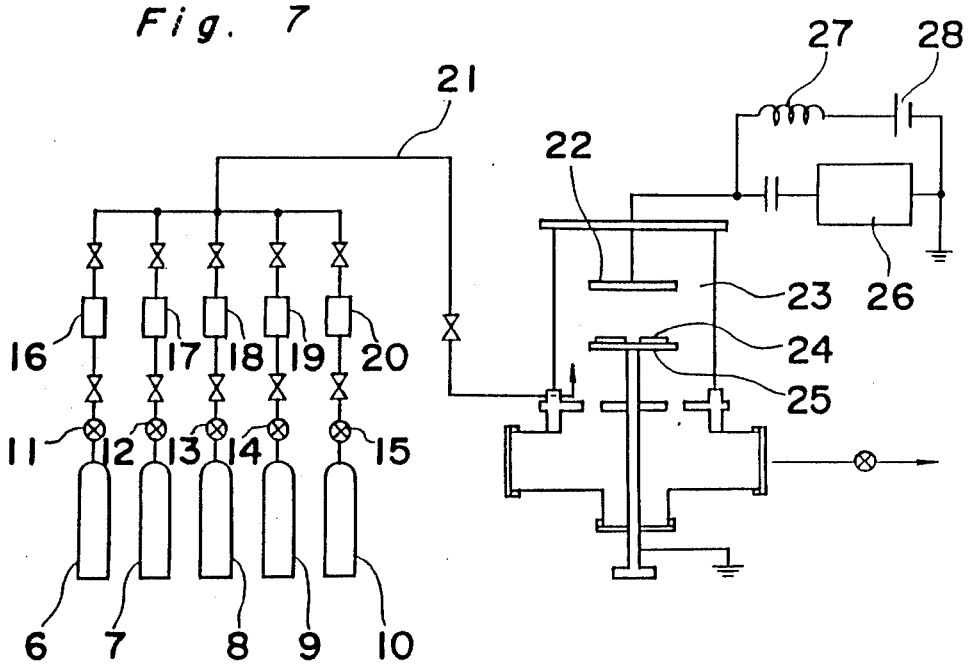
FIGS. 7–9 are examples of apparatus for production of photosensitive member of the present invention.
Figure 8:
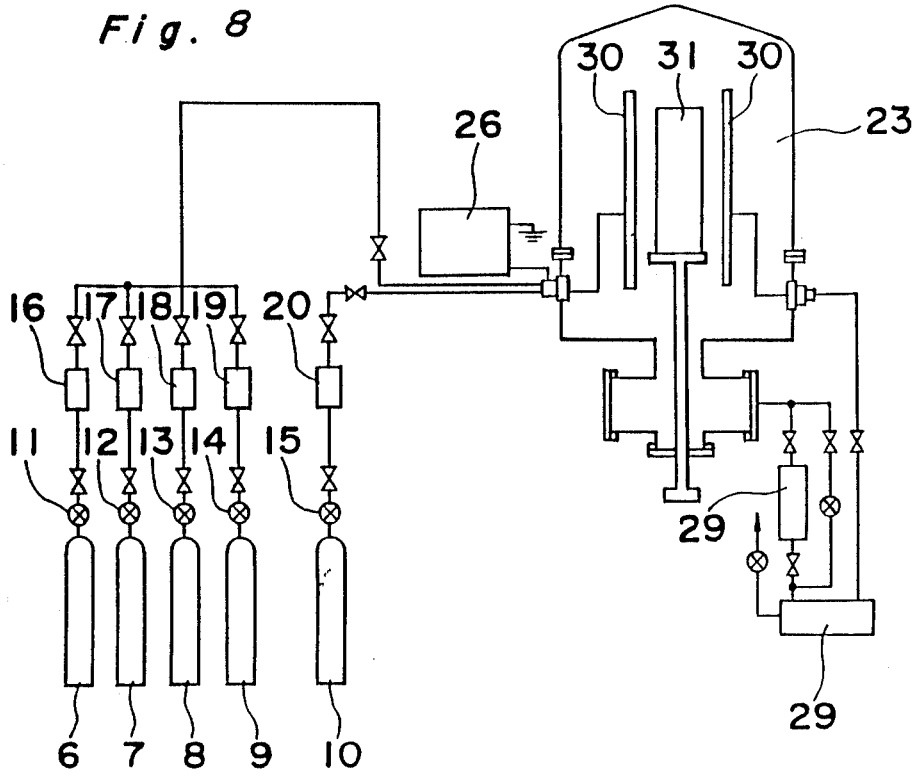

FIGS. 7 and 8 illustrate a capacitive coupling type plasma CVD apparatus for the production of photosensitive member of the present invention. FIG. 7 shows a parallel plate type plasma CVD apparatus, and FIG. 8 shows a tubular plasma CVD apparatus. Both apparatuses are different in that electrodes (22) and (25) and the substrate (24) of FIG. 7 are plates, but in FIG. 8 the electrode (30) and the substrate (31) are tubular. In the present invention, of course, a photosensitive member can be produced by an induction coupling type plasma CVD apparatus.

Production of the photosensitive member of the present invention is illustrated according to the parallel plate type plasma CVD apparatus (FIG. 7). In FIG. 7, (6)–(10) show the 1st to 5th tanks for $C_2H_4$, $H_2$, $B_2H_6$, $SiH_4$ and $N_2O$ gases respectively, each of which is connected to the 1st to 5th control valves (11)–(15) and the 1st to 5th mass flow controllers (16) to (20) respectively. These gases are sent to a reactor (23) through a main pipe (21).

In the reactor (23) a grounded electrode plate (25), on which the electroconductive substrate such as an Al plate (24) is arranged, is electrically connected with the plate-like electrode (22) which is connected with a high frequency current source (26), facing each other through a condenser. The electrode (22) is connected with a direct current source (28) through a coil (27) in such a manner that a bias is applied in addition to the electric power from the frequency current source (26). The electroconductive substrate (24), set on the electrode (25), is arranged such that it can be heated to, for example, 350° C. by a heating means (not illustrated).

When a photosensitive member illustrated in FIG. 1, for example, is prepared with $C_2H_4$ gas, $H_2$ gas as a carrier, and $B_2H_6$ gas the gases may be supplied from the 1st tank (6), the 2nd and the 3rd tank (7), (8) respectively through the main pipe (21) after the reactor (23) is maintained at a constant vacuum. Then an electric power of 0.03–1 kw is applied from the frequency current source (26) to the electrode (22), and, if desired, DC bias of 0.05–2 KV is applied from DC power source (28) to cause plasma discharge between both electrodes to form a C:H undercoat layer (4) of 0.01 to 5 μm thick on a preheated substrate (24). The C:H undercoat layer contains boron, and hydrogen at a content of 0.1–67 atomic percent. The hydrogen content of the C:H undercoat layer (4) is depended on conditions for production such as a kind of starting material, ratio of the material and a diluting gas ($H_2$ gas or inert gas such as He), discharging power, pressure, substrate temperature, DC bias, anneal temperature, and the frequency at discharge. The hydrogen content can be controlled by varying the bias from 0.05 to 1 kv. That is, the hydrogen content can be reduced by applying a higher bias so as to make the C:H layer harder. If $PH_3$ gas is used instead of $B_2H_6$, the layer can be controlled to be a N type.

When the $C_2H_4$ gas and $H_2$ gas are supplied from the first tank and the second tank respectively and plasma charge is applied to form a C:H charge transporting layer (2) of 5–50 μm in thickness.

The hydrogen content of the C:H undercoat layer (4) is dependent on conditions as described above. The C:H charge transporting layer obtained has excellent light transmittance, a dark resistance and a transportability. The layer may be controlled to be a P type by introduction of $B_2H_6$ gas from the third tank (8) and $N_2O$ gas from 5th tank (10) to improve the charge transportability still more. If $PH_3$ gas is used instead of $B_2H_6$, the layer can be controlled to be an N type.

For the charge generating layer (3) a layer mainly made of a-Si may be applied by introduction of $H_2$ gas and $SiH_4$ from the 2nd tank (7) and the 4th tank (8) respectively.

The egopt is dependent on a kind of starting gaseous materials, the ratio of the starting material to diluting gas ($H_2$ and inert gas etc.), charging power, pressure, substrate temperature, DC bias, anneal temperature, discharging frequency and the like. Discharging power, substrate temperature especially and anneal temperature affect Egopt.

The egopt of the present invention can be calculated from the absorption edge by the formula of $\sqrt{\alpha h\nu - h\nu}$ wherein $\alpha$ represents the absorption coefficient and $h\nu$ represents light energy.

The relative dielectric constant of the C:H layer is dependent on the kind of starting gaseous materials, the DC bias generated by discharge or applied from outside, discharging power and the like, and can be controlled by changing them.

Figure 9:
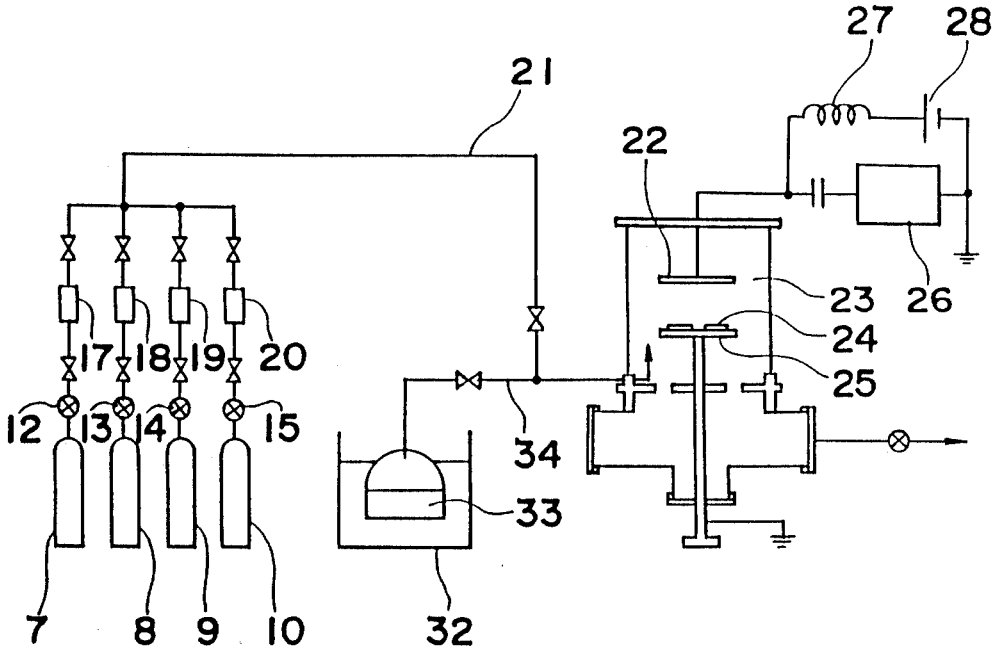

A capacitance coupling CVD apparatus as shown in FIG. 9 illustrates an embodiment using a monomer such as $C_8H_8$ as a source of the C:H layer, in which a monomer (33) in a constant temperature bath (32) as well as a pipe (34) connected with the reactor, is heated for introduction into the reactor (23) as a vapor. The other constitutions are the same as the apparatus shown in FIG. 7.

The photosensitive member of the present invention has excellent charge transportability and charging capacity, and sufficient surface potential can be obtained even when the thickness of the C:H layer is thin.

Further, by using a hydrogen-containing layer adjusted to the charging polarity as an undercoat layer, the injection of charges can be prevented. Moreover, the photosensitive member of the present invention has reduced residual potential, improved sensitivity and adhesivity to the substrate.

The production costs are not as expensive, and the production time is short, because the cost of the raw material is cheap, every layer can be formed in the same reactor, and the layers may be thin. Even a thin C:H layer can be easily produced without pin holes to be easily made thin. If the C:H layer of the present invention is used as an outermost surface, durability of the photosensitive member is improved because of its excellent resistance to corona, acids, moisture, heat and rigidity.

The present invention is illustrated according to following examples, but it should not be construed restrictively to them.

EXAMPLE 1

(I) Formation of C:H undercoat layer

In the glow discharge decomposition apparatus shown in FIG. 7, the reactor (23) is evacuated to a high vacuum of about $10^{-6}$ Torr, and then the 1st, 2nd and 3rd controlling valves (11), (12) and (13) are opened to send $C_2H_4$ gas from the 1st tank (6), $H_2$ gas from the 2nd tank (7) and $B_2H_6$ gas from 3rd tank (8) to mass flow controllers (16) (17) and (18) respectively under an output gauge of 1 Kg/cm$^2$. Thereafter, the flow rate of $C_2H_4$ gas and $B_2H_6$ plus $H_2$ gas and a ratio of $B_2H_6/C_2H_4$ were set on 50 sccm and 150 sccm and 30 ppm respectively by adjusting the scales of the respective mass flow controllers, and the gases were sent to the reactor (23). After the flow rate of every gas was stabilized, the inner pressure of the reactor was adjusted to 0.3 Torr. Separately, an aluminum plate of 3×50×50 mm, the electroconductive substrate (24), was preheated to 250° C. When both the flow rate of the gases and the inner pressure were stabilized, a high-frequency power of 100 watts (frequency, 13.56 MHz) was applied to the electrode (22) from the power source (26) with DC bias (+700 V) to continue plasma polymerization for 1 hours to from the C:H undercoat layer of about 1.0 μm thick (H content: about 45 atomic %) on the substrate (24).

(II) Formation of C:H charge transporting layer

In the glow discharge decomposition apparatus shown in FIG. 7, the reactor (23) is evacuated to a high vacuum of about $10^{-6}$ Torr, and then the 1st and 2nd controlling valves (11) and (12) are opened to sent $C_2H_4$ gas from the 1st tank (6), and $H_2$ gas from the 2nd tank (7) to mass flow controllers (16) and (17) respectively under an output gauge of 1 Kg/cm$^2$. Thereafter, the flow rate of $C_2H_4$ gas and $H_2$ were set on 60 sccm and 40 sccm respectively by adjusting the scales of the respective mass flow controllers, and the gases were sent to the reactor (23). After the flow rate of every gas was stabilized, the inner pressure of the reactor was adjusted to 1.0 Torr. Separately, an aluminum plate of 3×50×50 mm as an electroconductive substrate (24), was preheated to 250° C. When both the flow rate of the gases and the inner pressure were stabilized, a high-frequency power of 200 watts (frequency, 13.56 MHz) was applied to the electrode (22) from the power source (26) with DC bias (+700 V) to continue plasma polymerization for 7 hours to form C:H charge transporting layer of about 10 μm thick (H content: about 56 atomic %) on the on the undercoat layer.

(III) Formation of a-Si charge generating Layer

The application of power from the high frequency power source was temporarily stopped, and the reactor was evacuated.

The 4th, 2nd and 3rd controlling valves (14), (12) and (13) were opened to sent $SiH_4$ gas from the 4th tank (9), $H_2$ gas from the 2nd tank (7) and $B_2H_6$ gas from 3rd tank (8) to mass flow controllers (19), (17) and (18) respectively under an output gauge pressure of 1 $Kg/cm^2$. The flow rates of $SiH_4$ and $H_2$ and a ratio of $B_2H_6/SiH_4$ were set on 90 sccm and 210 sccm and 20 ppm respectively by adjusting the gauge of the mass flow controllers and both gases were sent to the reactor. After the flow rates were stabilized, the inner pressure of the reactor (23) was adjusted to 1.0 Torr.

When the flow rate and the inner pressure were stabilized, a high frequency power (frequency, 13.56 MHz) of 10 watts was applied, to the substrate with the C:H charge transporting layer, from the electrode (22) to generate the glow discharge. This glow discharge was continued for 40 minutes to form an 1 μm thick a-Si charge generating layer.

The photosensitive member obtained had an initial surface charge (Vo) of +600 V, an exposure for half reduction of surface potential ($E_{\frac{1}{2}}$) of 2.7 lux.sec. A clear copy was from the obtained photosensitive member.

The properties of the above photosensitive member, i.e. an initial surface potential, and exposure amount of half reduction of surface potential and residual potential are evaluated in the following table as excellent (o), good (Δ), unacceptable (x), so the excellence of the invention is understood.

| properties | evaluation o | Δ | x |
|---|---|---|---|
| $V_0$ (V)/member thickness (μm) | 70–40 | 40–10 | 10–0 |
| $E_{\frac{1}{2}}$ (lux.sec) | 1.9–3.6 | 3.7–6.9 | 7.0– |
| $V_r/V_0$ (%) | 0–25 | 25–50 | 50–100 |

In the Tables, the separateness is evaluated as follows:
o . . . no separation,
Δ . . . partial separation,
x . . . entire separation.

EXAMPLE 2–13 AND 15–24

Photosensitive members having an undercoat layer, a charge transporting layer and a charge generating layer were prepared in a manner similar to Example 1 under conditions as shown in Tables 2–13 and 15–24. Results obtained were shown in the tables.

EXAMPLE 14

| Formulation | parts by weight |
|---|---|
| styrene | 200 |
| methyl methacrylate | 160 |
| n-butyl acrylate | 75 |
| β-hydroxypropyl acrylate | 55 |
| maleic acid | 8 |
| benzoyl peroxide | 7.5 |
| ethylene glycol monomethyl ether | 150 |

The mixture obtained from the above formulation was added dropwise to a reaction vessel containing xylene (350 parts by weight) with stirring under nitrogen atmosphere at 105° C. for 2 hours to react. After 2.5 hours elapsed since the initiation of the polymerization additional benzoyl peroxide (0.5 part by weight) was added to react for 8 hours as stirring under heating to give a thermoset hydroxyl-containing acrylic resin (viscosity: 800 cps, solid: 50%).

The thermoset hydroxyl-containing acrylic resin (34 parts by weight), melamine resin (Super Beckamine J 820; available from Dainippon Ink & Chemicals Inc.) (6 parts by weight), 2,4,5,7-tetranitro-9-fluorenone (0.5 parts by weight), ε-copper phthalocyanine available from Toyo Ink Co., Ltd. (20 parts by weight), cellosolve acetate (40 parts by weight) and methyl ethyl ketone (40 parts by weight) were blended in a ball mill pot for 30 hours to give a photoelectroconductive paint. The obtained paint was coated on the surface of a C:H charge transporting layer obtained under the conditions as shown in Table 14, dried and then cured to give a photosensitive member for electrophotography. The member had an electrophotoconductive layer of 1 μm in thickness. The results are shown in Table 14.

COMPARATIVE EXAMPLES 1–4

Photosensitive members were prepared according to the same manner as in Example 1 except that conditions as shown in Tables 25–28 were used. Properties of obtained photosensitive members were shown in the Tables.

COMPARATIVE EXAMPLE 5

A photosensitive member was prepared under the conditions indicated in Table 29. The obtained photosensitive member had an C:H undercoat layer and an a-Si charge generating layer.

Results are shown in Table 29.

COMPARATIVE EXAMPLE 6

An undercoat layer was prepared on an aluminum plate under the conditions indicated in Table 30, on which a polyethylene layer was formed by a conventional organic polymerization, and then an a-Si:H layer having a thickness of 1 μm was applied under the conditions shown in Table 30 on the polyethylene layer to give a photosensitive layer. The charging property of the obtained photosensitive member is equal to that of the member of Example 1, but as to sensitivity it shows so slight a potential reduction due to the a-Si:H layer that the potential does not decrease to a value of half reduction. The results are shown in Table 30.

COMPARATIVE EXAMPLE 7

Figure 10:
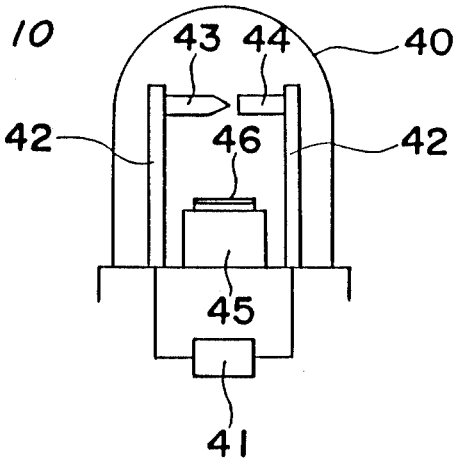
FIG. 10 shows an apparatus for arc deposition used in comparative examples.

An undercoat layer was prepared using an arc discharged vapor deposition device as shown in FIG. 10 under the conditions indicated in Table 31, on which a carbon layer not containing hydrogen was formed. In FIG. 9 electrode supporting rods (42) connected with an electric power source (41) were arranged in a vacuumed vessel (40) on a substrate supporting base (45) and carbon electrodes (43) and (44) were connected to each rod (42). An A1 substrate (46) was put on the base (45), and then the arc discharge was caused by reducing the inner pressure of the vessel to $10^{-5}$ Torr and controlling the electric current to the carbon electrodes at 50 A to make a carbon layer not containing hydrogen and having a thickness of 5 μm on the A1 substrate. The obtained carbon layer has only less than $10^8$ Ω.cm, which is insufficient to be used as an electrophotosensitive member.

Further, an a-Si:H layer deposited on the carbon layer under the conditions indicated in Table 31 was easily exfoliated.

TABLE 1

| | undercoat layer | CTL(1) | CGL(2) |
|---|---|---|---|
| $C_2H_4$ (sccm) | 50 | 60 | 0 |

TABLE 1-continued

| | under-coat layer | CTL[1] | CGL[2] |
|---|---|---|---|
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 3 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $3\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | 2.7 | |
| separateness[3] | | o | |
| residual potential Vr (V) | | o | |
| repetition stability | | o | |

[1]charge transporting layer (abbreviated to CTL hereinafter)
[2]charge generating layer (abbreviated to CGL hereinafter)
[3]adhesive properties of adhesive layer with a substrate after left alone overnight in condition of 30° C.; 85% RH

TABLE 2

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 10 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $10\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | 2.7 | |
| separateness | | o | |
| residual potential Vr (V) | | o | |
| repetition stability | | o | |

TABLE 3

| | under-coat layer | CTL | CGL |
|---|---|---|---|
| $C_2H_4$ (sccm) | 50 | 60 | 0 |

TABLE 3-continued

| | under-coat layer | CTL | CGL |
|---|---|---|---|
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 100 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $100\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | 2.7 | |
| separateness | | o | |
| residual potential Vr (V) | | o | |
| repetition stability | | o | |

TABLE 4

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 1000 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | 2.7 | |
| separateness | | o | |
| residual potential Vr (V) | | o | |
| repetition stability | | o | |

TABLE 5

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |

TABLE 5-continued

| | under-coat layer | CTL | CGL |
|---|---|---|---|
| $B_2H_6/SiH_4$ (ppm) | | | 20 |
| $B_2H_6/C_2H_4$ (ppm) | 5000 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $5000\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +400 | |
| $E_{\frac{1}{2}}$ (lux.sec) | | 2.7 | |
| separateness | | o | |
| residual potential Vr (V) | | o | |
| repetition stability | | o | |

TABLE 6

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | 20 | | |
| $B_2H_6/C_2H_4$ (ppm) | 20000 | | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $20000\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +200 | |
| $E_{\frac{1}{2}}$ (lux.sec) | | 2.7 | |
| separateness | | o | |
| residual potential Vr (V) | | o | |
| repetition stability | | o | |

TABLE 7

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 1 | — | 0 |

TABLE 7-continued

| | under-coat layer | CTL | CGL |
|---|---|---|---|
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $1\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −600 | |
| $E_{\frac{1}{2}}$ (lux.sec) | | 3.2 | |
| separateness | | o | |
| residual potential Vr (V) | | o | |
| repetition stability | | o | |

TABLE 8

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 10 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $10\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −600 | |
| $E_{\frac{1}{2}}$ (lux.sec) | | 2.8 | |
| separateness | | o | |
| residual potential Vr (V) | | o | |
| repetition stability | | o | |

TABLE 9

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 100 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |

TABLE 9-continued

| | under-coat layer | CTL | CGL |
|---|---|---|---|
| thickness of layer (μm) | 1 | 10 | 0.5 |
| additional matter content (atomic %) | $100\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −600 | |
| $E_{\frac{1}{2}}$ (lux.sec) | | 2.8 | |
| separateness | | o | |
| residual potential Vr (V) | | o | |
| repetition stability | | o | |

TABLE 10

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 1000 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $1000\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −600 | |
| $E_{\frac{1}{2}}$ (lux.sec) | | 2.8 | |
| separateness | | o | |
| residual potential Vr (V) | | o | |
| repetition stability | | o | |

TABLE 11

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 5000 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |

TABLE 11-continued

| | under-coat layer | CTL | CGL |
|---|---|---|---|
| additional matter content (atomic %) | $5000\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −400 | |
| $E_{\frac{1}{2}}$ (lux.sec) | | 2.8 | |
| separateness | | o | |
| residual potential Vr (V) | | o | |
| repetition stability | | o | |

TABLE 12

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 20000 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $20000\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −200 | |
| $E_{\frac{1}{2}}$ (lux.sec) | | 2.8 | |
| separateness | | o | |
| residual potential Vr (V) | | o | |
| repetition stability | | o | |

TABLE 13

| | under-coat layer | CTL | CGL |
|---|---|---|---|
| $C_2H_4$ (sccm) | 50 | 30 | 0 |
| $H_2$ (sccm) | | 40 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 100 | 10 |
| inner pressure of reactor (Torr) | 0.3 | 0.5 | 1.0 |
| time | 1 (hour) | 4 (hour) | 40 (minute) |
| thickness of layer (μm) | 1 | 5 | 1 |
| additional matter content (atomic %) | $1000\left(\frac{P}{C+P}\right)$ | | $20\left(\frac{B}{Si+B}\right)$ |

TABLE 13-continued

| | under-coat layer | CTL | CGL |
|---|---|---|---|
| hydrogen content (atomic %) = $\frac{H}{\text{all atoms}}$ | 45 | 50 | 20 |
| $V_0$ (V) | | +360 | |
| $E_{\frac{1}{2}}$ (lux.sec) | | 2.0 | |
| separateness | | o | |
| residual potential Vr (V) | | o | |
| repetition stability | | o | |

TABLE 14

| | under-coat layer | CTL | CGL |
|---|---|---|---|
| $C_2H_4$ (sccm) | 50 | 30 | |
| $H_2$ (sccm) | | 40 | |
| $SiH_4$ (sccm) | | 0 | |
| $B_2H_6 + H_2$ (sccm) | 150 | 0 | |
| $B_2H_6/C_2H_4$ (ppm) | 1000 | — | |
| Power (W) | 100 | 100 | |
| inner pressure of reactor (Torr) | 0.3 | 0.5 | |
| time | 1 (hour) | 4 (hour) | |
| thickness of layer (μm) | 1 | 5 | |
| additional matter content (atomic %) | $1000\left(\frac{B}{C+B}\right)$ | | |
| hydrogen content (atomic %) = $\frac{H}{\text{all atoms}}$ | 45 | 50 | |
| $V_0$ (V) | | +300 | |
| $E_{\frac{1}{2}}$ (lux.sec) | | 5.0 | |
| separateness | | o | |
| residual potential Vr (V) | | o | |
| repetition stability | | o | |

TABLE 15

| | under-coat layer | CTL | CGL |
|---|---|---|---|
| $C_2H_4$ (sccm) | 50 | 30 | 0 |
| $H_2$ (sccm) | | 40 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 100 | 10 |
| inner pressure of reactor (Torr) | 0.3 | 0.5 | 1.0 |
| time | 1 (hour) | 8 (hour) | 40 (minute) |
| thickness of layer (μm) | 1 | 5.7 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 56 | 20 |

TABLE 15-continued

| | under-coat layer | CTL | CGL |
|---|---|---|---|
| $V_0$ (V) | | +400 | |
| $E_{\frac{1}{2}}$ (lux.sec) | | 2.0 | |
| separateness | | o | |
| residual potential Vr (V) | | o | |
| repetition stability | | o | |

TABLE 16

| | under-coat layer | CTL | CGL |
|---|---|---|---|
| $C_2H_4$ (sccm) | 50 | 90 | 0 |
| $H_2$ (sccm) | | 120 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 300 | 10 |
| inner pressure of reactor (Torr) | 0.3 | 0.5 | 1.0 |
| time | 1 (hour) | 8 (hour) | 40 (minute) |
| thickness of layer (μm) | 1 | 12 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 49 | 20 |
| $V_0$ (V) | | +530 | |
| $E_{\frac{1}{2}}$ (lux.sec) | | 3.5 | |
| separateness | | o | |
| residual potential Vr (V) | | o | |
| repetition stability | | o | |

TABLE 17

| | under-coat layer | CTL | CGL |
|---|---|---|---|
| $C_2H_4$ (sccm) | 50 | 180 | 0 |
| $H_2$ (sccm) | | 240 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 600 | 10 |
| inner pressure of reactor (Torr) | 0.3 | 0.5 | 1.0 |
| time | 1 (hour) | 8 (hour) | 40 (minute) |
| thickness of layer (μm) | 1 | 16 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 37 | 20 |
| $V_0$ (V) | | +510 | |
| $E_{\frac{1}{2}}$ (lux.sec) | | 5.0 | |
| separateness | | o | |
| residual potential Vr (V) | | o | |

TABLE 17-continued

| | under-coat layer | CTL | CGL |
|---|---|---|---|
| repetition stability | | o | |

TABLE 18

| | under-coat layer | CTL | CGL |
|---|---|---|---|
| $C_2H_4$ (sccm) | 50 | 240 | 0 |
| $H_2$ (sccm) | | 320 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 800 | 10 |
| inner pressure of reactor (Torr) | 0.3 | 0.5 | 1.0 |
| time | 1 (hour) | 8 (hour) | 40 (minute) |
| thickness layer (μm) | 1 | 17 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 30 | 20 |
| $V_0$ (V) | | +450 | |
| $E_{\frac{1}{2}}$ (lux.sec) | | 5.8 | |
| separateness | | o | |
| residual potential Vr (V) | | o | |
| repetition stability | | Δ | |

TABLE 19

| | under-coat layer | CTL | CGL |
|---|---|---|---|
| $C_2H_4$ (sccm) | 50 | | 0 |
| $CH_4$ (sccm) | | 100 | |
| $H_2$ (sccm) | | | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 600 | 10 |
| inner pressure of reactor (Torr) | 0.3 | 0.2 | 1.0 |
| time | 1 (hour) | 16 (hour) | 40 (minute) |
| thickness of layer (μm) | 1 | 5.2 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 41 | 20 |
| $V_0$ (V) | | +200 | |
| $E_{\frac{1}{2}}$ (lux.sec) | | 5.3 | |
| separateness | | o | |
| residual potential Vr (V) | | o | |
| repetition stability | | o | |

TABLE 20

| | under-coat layer | CTL | CGL |
|---|---|---|---|
| $C_2H_4$ (sccm) | 50 | | 0 |
| $C_3H_8$ (sccm) | | 80 | |
| $H_2$ (sccm) | | 20 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 200 | 10 |
| inner pressure of reactor (Torr) | 0.3 | 1.0 | 1.0 |
| time | 1 (hour) | 6 (hour) | 40 (minute) |
| thickness of layer (μm) | 1 | 7.3 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 60 | 20 |
| $V_0$ (V) | | +480 | |
| $E_{\frac{1}{2}}$ (lux.sec) | | 5.7 | |
| separateness | | o | |
| residual potential Vr (V) | | o | |
| repetition stability | | Δ | |

TABLE 21

| | under-coat layer | CTL | CGL |
|---|---|---|---|
| $C_2H_4$ (sccm) | 50 | | 0 |
| i-$C_4H_{10}$ (sccm) | | 180 | |
| $H_2$ (sccm) | | 120 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 500 | 10 |
| inner pressure of reactor (Torr) | 0.3 | 0.5 | 1.0 |
| time | 1 (hour) | 8 (hour) | 40 (minute) |
| thickness of layer (μm) | 1 | 10 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 45 | 20 |
| $V_0$ (V) | | +390 | |
| $E_{\frac{1}{2}}$ (lux.sec) | | 4.5 | |
| separateness | | o | |
| residual potential Vr (V) | | o | |
| repetition stability | | o | |

TABLE 22

| | under-coat layer | CTL | CGL |
|---|---|---|---|
| $C_2H_4$ (sccm) | 50 | | 0 |
| $C_3H_6$ (sccm) | | 50 | |
| $H_2$ (sccm) | | 0 | 0 |

TABLE 22-continued

| | under-coat layer | CTL | CGL |
|---|---|---|---|
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 75 | 10 |
| inner pressure of reactor (Torr) | 0.3 | 0.25 | 1.0 |
| time | 1 (hour) | 2 (hour) | 40 (minute) |
| thickness of layer (μm) | 1 | 6.8 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 46 | 20 |
| $V_0$ (V) | | +440 | |
| $E_{\frac{1}{2}}$ (lux.sec) | | 2.2 | |
| separateness | | o | |
| residual potential Vr (V) | | o | |
| repetition stability | | o | |

TABLE 23

| | under-coat layer | CTL | CGL |
|---|---|---|---|
| $C_2H_4$ (sccm) | 50 | | 0 |
| $CH_4$ (sccm) | | 30 | |
| $H_2$ (sccm) | | 30 | 0 |
| $SiH_4$ (sccm) | | 0 | 90 |
| $B_2H_6 + H_2$ (sccm) | 150 | 0 | 210 |
| $B_2H_6/C_2H_4$ (ppm) | 1000 | — | 0 |
| Power (W) | 100 | 5 | 10 |
| inner pressure of reactor (Torr) | 0.3 | 0.5 | 1.0 |
| time | 1 (hour) | 8 (hour) | 40 (minute) |
| thickness of layer (μm) | 1 | 5 | 0.5 |
| additional matter content (atomic %) | $1000\left(\frac{B}{C+B}\right)$ | | $20\left(\frac{B}{Si+B}\right)$ |
| hydrogen content (atomic %) = $\frac{H}{\text{all atoms}}$ | 45 | 10 | 20 |
| $V_0$ (V) | | +300 | |
| $E_{\frac{1}{2}}$ (lux.sec) | | 2.2 | |
| separateness | | o | |
| residual potential Vr (V) | | o | |
| repetition stability | | Δ | |

TABLE 24

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 1 | | |

TABLE 24-continued

| | under-coat layer | CTL | CGL |
|---|---|---|---|
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $1\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | 3.7 | |
| separateness | | o | |
| residual potential Vr (V) | | o | |
| repetition stability | | Δ | |

TABLE 25

| | under-coat layer | CTL | CGL |
|---|---|---|---|
| $C_2H_4$ (sccm) | 50 | 60 | 0 |
| $H_2$ (sccm) | 150 | 40 | |
| $SiH_4$ (sccm) | | 0 | 90 |
| $B_2H_6 + H_2$ (sccm) | 0 | 0 | 210 |
| $B_2H_6/SiH_4$ (ppm) | | | 20 |
| $B_2H_6/C_2H_4$ (ppm) | 0 | — | |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $0\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +600 | |
| $E_{\frac{1}{2}}$ (lux.sec) | | >10 | |
| separateness | | Δ | |
| residual potential Vr (V) | | Δ | |
| repetition stability | | x | |

TABLE 26

| | under-coat layer | CTL | CGL |
|---|---|---|---|
| $C_2H_4$ (sccm) | 50 | 60 | 0 |
| $H_2$ (sccm) | | 40 | |
| $SiH_4$ (sccm) | | 0 | 90 |
| $B_2H_6 + H_2$ (sccm) | 150 | 0 | 210 |
| $B_2H_6/SiH_4$ (ppm) | | | 20 |
| $B_2H_6/C_2H_4$ (ppm) | 30000 | — | |
| Power (W) | 100 | 200 | 10 |

TABLE 26-continued

| | under-coat layer | CTL | CGL |
|---|---|---|---|
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $30000\left(\frac{B}{C+B}\right)$ | | $20\left(\frac{B}{Si+B}\right)$ |
| hydrogen content (atomic %) = $\frac{H}{\text{all atoms}}$ | 45 | 56 | — |
| $V_0$ (V) | | +100 | |
| $E_{\frac{1}{2}}$ (lux.sec) | | 2.7 | |
| separateness | | o | |
| residual potential Vr (V) | | o | |
| repetition stability | | o | |

TABLE 27

| | under-coat layer | CTL | CGL |
|---|---|---|---|
| $C_2H_4$ (sccm) | 50 | 60 | 0 |
| $H_2$ (sccm) | 150 | 40 | 210 |
| $SiH_4$ (sccm) | | 0 | 90 |
| $PH_3 + H_2$ (sccm) | 0 | 0 | 0 |
| $PH_3/C_2H_4$ (ppm) | 0 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $0\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −600 | |
| $E_{\frac{1}{2}}$ (lux.sec) | | >10 | |
| separateness | | Δ | |
| residual potential Vr (V) | | x | |
| repetition stability | | x | |

TABLE 28

| | under-coat layer | CTL | CGL |
|---|---|---|---|
| $C_2H_4$ (sccm) | 50 | 60 | 0 |
| $H_2$ (sccm) | | 40 | 210 |
| $SiH_4$ (sccm) | | 0 | 90 |
| $PH_3 + H_2$ (sccm) | 150 | 0 | 0 |
| $PH_3/C_2H_4$ (ppm) | 30000 | — | 0 |
| Power (W) | 100 | 200 | 10 |
| inner pressure of reactor (Torr) | 0.3 | 1.0 | 1.0 |
| time | 1 (hour) | 7 (hour) | 40 (minute) |
| thickness of layer (μm) | 1 | 10 | 0.5 |
| additional matter content (atomic %) | $30000\left(\frac{P}{C+P}\right)$ | | $0\left(\frac{B}{Si+B}\right)$ |
| hydrogen content (atomic %) = $\frac{H}{\text{all atoms}}$ | 45 | 56 | 20 |
| $V_0$ (V) | | −100 | |
| $E_{\frac{1}{2}}$ (lux.sec) | | 2.8 | |
| separateness | | o | |
| residual potential Vr (V) | | o | |
| repetition stability | | o | |

TABLE 29

| | under-coat layer | CTL | CGL |
|---|---|---|---|
| $C_2H_4$ (sccm) | 50 | | 0 |
| $H_2$ (sccm) | | | 210 |
| $SiH_4$ (sccm) | | | 90 |
| $B_2H_6 + H_2$ (sccm) | 150 | | 0 |
| $B_2H_6/C_2H_4$ (ppm) | 1000 | | 0 |
| Power (W) | 100 | | 10 |
| inner pressure of reactor (Torr) | 0.3 | | 1.0 |
| time | 1 (hour) | | 40 (minute) |
| thickness of layer (μm) | 1 | | 5 |
| additional matter content (atomic %) | $1000\left(\frac{B}{C+B}\right)$ | | $0\left(\frac{B}{Si+B}\right)$ |
| hydrogen content (atomic %) = $\frac{H}{\text{all atoms}}$ | 45 | | 20 |
| $V_0$ (V) | | −110 | |
| $E_{\frac{1}{2}}$ (lux.sec) | | 8 | |
| separateness | | o | |
| residual potential Vr (V) | | o | |
| repetition stability | | x | |

TABLE 30

| | under-coat layer | CTL | CGL |
|---|---|---|---|
| $C_2H_4$ (sccm) | 50 | | 0 |
| $H_2$ (sccm) | | | 210 |
| $SiH_4$ (sccm) | | | 90 |
| $B_2H_6 + H_2$ (sccm) | 150 | | 0 |
| $B_2H_6/C_2H_4$ (ppm) | 1000 | | 0 |
| Power (W) | 100 | | 10 |
| inner pressure of reactor (Torr) | 0.3 | | 1.0 |
| time | 1 (hour) | | 80 (minute) |
| thickness of layer (μm) | 1 | | 1 |

TABLE 30-continued

| | under-coat layer | CTL | CGL |
|---|---|---|---|
| additional matter content (atomic %) | $1000\left(\frac{B}{C+B}\right)$ | | $0\left(\frac{B}{Si+B}\right)$ |
| hydrogen content (atomic %) = $\frac{H}{\text{all atoms}}$ | 45 | | 20 |
| $V_0$ (V) | | −660 | |
| $E_{\frac{1}{2}}$ (lux.sec) | | not reached to half value of exposed dose | |
| separateness | | o | |
| residual potential Vr (V) | | x | |
| repetition stability | | x | |

TABLE 31

| | under-coat layer | CTL | CGL |
|---|---|---|---|
| $C_2H_4$ (sccm) | 50 | | 0 |
| $H_2$ (sccm) | | | 210 |
| $SiH_4$ (sccm) | | | 90 |
| $B_2H_6 + H_2$ (sccm) | 150 | | 0 |
| $B_2H_6/C_2H_4$ (ppm) | 1000 | | 0 |
| Power (W) | 100 | | 10 |
| inner pressure of reactor (Torr) | 0.3 | | 1.0 |
| time | 1 (hour) | | 40 (minute) |
| thickness of layer (μm) | 1 | | 1 |
| additional matter content (atomic %) | $1000\left(\frac{B}{C+B}\right)$ | | $0\left(\frac{B}{Si+B}\right)$ |
| hydrogen content (atomic %) = $\frac{H}{\text{all atoms}}$ | 45 | | 20 |
| $V_0$ (V) | | — | |
| $E_{\frac{1}{2}}$ (lux.sec) | | — | |
| separateness | | o | |
| residual potential Vr (V) | | o | |
| repetition stability | | — | |

What is claimed is:

1. A photosensitive member comprising:

an electrically conductive substrate;

an undercoat layer formed on said substrate and comprising amorphous carbon containing hydrogen, said undercoat layer comprises an impurity element in Group IIIA or VA of the Periodic Table, said undercoat layer having a thickness of about 0.01 to 5 μm;

a charge transporting layer comprising amorphous carbon containing hydrogen, said hydrogen being contained in an amount of about 0.1 to 67 atomic percent based on an amount of all atoms contained therein; and a charge generating layer.

2. A photosensitive member comprising:

an electrically conductive substrate;

an undercoat layer formed on said substrate and comprising amorphous carbon containing hydrogen, said undercoat layer comprising less than about 20000 ppm of an impurity element in Group IIIA or Group VA of the Periodic Table, said undercoat layer having a thickness of about 0.01 to 5 μm and said hydrogen being contained in an amount of about 0.1 to 67 atomic percent based in the amount of all atoms contained therein;

a charge transporting layer comprising amorphous carbon containing hydrogen, said hydrogen being contained in an amount of about 0.1 to 67 atomic percent based on an amount of all atoms contained therein; and a charge generating layer.

3. A photosensitive member of claim 2 wherein the impurity element in Group IIIA of the Periodic Table is preferably contained in an amount of about 3 to 1000 ppm.

4. A photosensitive member of claim 3 wherein the impurity element in Group IIIA of the Periodic Table is preferably boron.

5. A photosensitive member of claim 2 wherein the impurity element in Group VA of the Periodic Table is preferably contained in an amount of about 1 to 1000 ppm.

6. A photosensitive member of claim 5 wherein the impurity element in Group VA of the Periodic Table is preferably phosphorus.

7. A photosensitive member of claim 2 wherein the amount of the hydrogen contained in said undercoat layer is about 0.1 to 67 atomic percent based on the amount of all atoms contained therein.

8. A photosensitive member comprising:

an electrically conductive substrate;

an undercoat layer formed on said substrate and comprising amorphous carbon containing hydrogen, said undercoat layer comprising less than about 20000 ppm of an impurity element in Group IIIA or Group VA of the Periodic Table, said undercoat layer having a thickness of about 0.01 to 5 μm and said hydrogen being contained in an amount of about 0.1 to 67 atomic percent based on the amount of all atoms contained therein;

a charge transporting layer comprising amorphous carbon containing hydrogen, said hydrogen being contained in an amount of about 0.1 to 67 atomic percent based on an amount of all atoms contained therein;

said charge transporting layer containing an impurity element in Group IIIA or VA of the Periodic Table to adjust its polarity, the content of said element being less than that in said undercoat layer; and a charge generating layer.

9. A photosensitive member of claim 2, wherein said charge transporting layer has a relative dielectric constant of about 2.0 to 6.0.

10. A photosensitive member comprising:

an electrically conductive substrate;

an undercoat layer formed on said substrate and comprising amorphous carbon containing hydrogen, said undercoat layer comprising less than about 20000 ppm of an impurity element in Group IIIA or Group VA of the Periodic Table, said undercoat layer having a thickness of about 0.01 to 5 μm and said hydrogen being contained in an amount of about 0.1 to 67 atomic percent based on the amount of all atoms contained therein;

a charge transporting layer comprising amorphous carbon containing hydrogen, said hydrogen being contained in an amount of about 0.1 to 67 atomic percent based on an amount of all atoms contained therein, said charge transporting layer having a relative dielectric constant of 2.0 to 6.0; and a charge generating layer.

11. A photosensitive member of claim 10, wherein said undercoat layer contains the impurity element in Group IIIA of the Periodic Table so that the layer in the vicinity of the substrate is controlled to be P-type while the layer in the vicinity of the surface of the photosensitive member is controlled to be N-type for positive charging.

12. A photosensitive member of claim 12, wherein the impurity element in Group IIIA of the Periodic Table is contained in an amount of about 3 to 1000 ppm.

13. A photosensitive member of claim 12, wherein the impurity element in Group IIIA of the Periodic Table is boron.

14. A photosensitive member of claim 10, wherein said undercoat layer contains the impurity element in Group VA of the Periodic Table so that the layer in the vicinity of the substrate is controlled to be N-type while the layer in the vicinity of the surface of the photosensitive member is controlled to be P-type for negative charging.

15. A photosensitive member of claim 14, wherein the impurity element in Group VA of the Periodic Table is preferably contained in an amount of about 1 to 1000 ppm.

16. A photosensitive member of claim 15, wherein the impurity element in Group VA of the Periodic Table is preferably phosphorus.

* * * * *